US007097558B2

(12) United States Patent
Berger

(10) Patent No.: US 7,097,558 B2
(45) Date of Patent: Aug. 29, 2006

(54) REGISTER ASSEMBLY WITH ADJUSTABLE FACEPLATE CONNECTORS

(75) Inventor: Brian K. Berger, Eureka, MO (US)

(73) Assignee: Innovative Vent Solutions, Inc., Pacific, MO (US)

( * ) Notice: Subject to any disclaimer, the term of this patent is extended or adjusted under 35 U.S.C. 154(b) by 0 days.

(21) Appl. No.: 10/977,969

(22) Filed: Oct. 29, 2004

(65) Prior Publication Data

US 2006/0094348 A1 May 4, 2006

(51) Int. Cl.
*F24F 7/00* (2006.01)

(52) U.S. Cl. ..... 454/289; 454/325

(58) Field of Classification Search ..... 454/289, 454/290, 318, 325
See application file for complete search history.

(56) References Cited

U.S. PATENT DOCUMENTS 5,163,871 A * 11/1992 Huibregtse et al. ..... 454/289
5,597,392 A * 1/1997 Hawkins et al. ..... 96/222
6,033,304 A * 3/2000 Haynes ..... 454/290
6,227,962 B1 * 5/2001 Orendorff ..... 454/290
6,537,146 B1 * 3/2003 Haynes ..... 454/290
6,710,241 B1 * 3/2004 Casper ..... 174/35 MS

* cited by examiner

*Primary Examiner*—Derek S. Boles
(74) *Attorney, Agent, or Firm*—Thompson Coburn LLP

(57) ABSTRACT

A register assembly with adjustable faceplate connectors can be used to cover air duct openings that supply a flow of heated or cooled air to a room of a structure, and can also be used to cover air duct openings that receive return air from the room. The register assembly includes a faceplate that has removably attachable connectors that adapt the faceplate to be removably attached to a plurality of damper assemblies of different sizes. The plurality of connectors are adjustably connected to the faceplate to adapt the faceplate to each different size of damper assembly.

17 Claims, 4 Drawing Sheets

REGISTER ASSEMBLY WITH ADJUSTABLE FACEPLATE CONNECTORS

BACKGROUND OF THE INVENTION (1) Field of the Invention

The present invention pertains to a register assembly that can be used to cover duct openings that supply a flow of heated or cooled air to a room of a structure, and can also be used to cover duct openings that receive return air from the room. In particular, the register assembly is comprised of a framed faceplate, a plurality of damper assemblies of different sizes, and a plurality of connectors that are adjustably connected to the faceplate to adapt the faceplate to each different size of damper assembly.

(2) Description of the Related Art

Very often in the heating and cooling systems of structures, and in particular residential structures, the network of air ducts that supply heated or cooled air to the different structures are constructed in various different sizes. This at times will result in the duct openings that supply air through openings cut in the floors and walls of the structure to be of different sizes. This does not often occur in individual home constructions, but it can be found that homes constructed in different years or by different construction contractors will have air duct openings that are of different sizes. For example, air duct openings of 2.25"×10", 2.25"×12", 3"×10", 4"×10", 4"×12", and 4"×14" are common.

The existence of air duct openings of different sizes makes choosing a register assembly for an existing home, or supplying register assemblies for a home under construction difficult. Not only must a desirable design for the register faceplate be chosen, but care must be taken to ensure that the register assembly is properly sized to fit the particular duct opening of the home. This requires that the air duct openings be carefully measured, and the properly dimensioned register assembly be obtained to fit each air duct opening.

SUMMARY OF THE INVENTION

The register assembly with the adjustable faceplate connectors of the present invention overcomes the disadvantages associated with the different sized air duct openings of homes and other structures. The register assembly of the invention is comprised of a framed faceplate, a plurality of damper assemblies that are each dimensioned to fit the duct opening dimensions commonly used in building construction, and a plurality of connectors that are adjustably fit to the faceplate to enable the removable attachment of the faceplate to each of the different sized damper assemblies.

The one faceplate is dimensioned to cover the various different sizes of duct openings. The outer peripheral border of the faceplate is dimensioned sufficiently large to extend beyond the perimeter dimensions of each of the commonly used duct openings. One or more holes are provided through the faceplate to provide the free flow of air through the faceplate. A variety of different faceplates could be provided with the holes of the faceplate cut in a variety of different patterns.

A plurality of different damper assemblies are provided, each being dimensioned to match the damper assembly with a particular size of duct opening. Each damper assembly is constructed with a base having four side walls that surround a center opening through the base. Examples of damper assemblies are disclosed in the U.S. Patents of Berger U.S. Pat. No. 6,309,297 B1 and U.S. Pat. No. 6,506,113 B2, the disclosures of each patent being incorporated herein by reference. Each damper assembly base contains one or more louvers that are movable relative to the base to control the flow of air through the damper assembly.

The plurality of connectors are each adapted to attach the faceplate to each of the different sizes of damper assemblies. Each of the connectors are identical in construction, reducing their cost to manufacture. Each of the connectors are removably attachable to the faceplate and are removably attachable to each of the different sized damper assemblies without the use of separate fasteners. Thus, the entire register assembly can be assembled without separate threaded fasteners. The connectors are removably attachable to the faceplate in a variety of adjusted positions. In each of the adjusted positions of the connectors relative to the faceplate, the connectors adapt the faceplate for removable attachment to one of the various different sizes of damper assemblies.

Thus, for any particular duct opening, an appropriately dimensioned damper assembly is chosen. A faceplate is chosen that has a desirable pattern of openings. The damper assembly is assembled over the air duct opening. The plurality of connectors are then removably attached to the faceplate in a particular pattern of the connectors relative to the faceplate to enable the removable attachment of the faceplate to the chosen damper assembly. The damper assembly is then removably attached to the plurality of connectors, thereby removably attaching the damper assembly to the faceplate.

In the manner discussed above, the register assembly of the invention is inexpensively and easily assembled over air duct openings of various different sizes. Thus, the register assembly of the invention simplifies the assembly of the air heating and cooling system and reduces the number of different parts needed to assemble the system, thereby reducing the cost of the systems assembly.

BRIEF DESCRIPTION OF THE DRAWINGS

Further features of the invention are set forth in the following detailed description of the preferred embodiment of the invention and in the drawing figures wherein.

DETAILED DESCRIPTION OF THE PREFERRED EMBODIMENT

Figure 1:
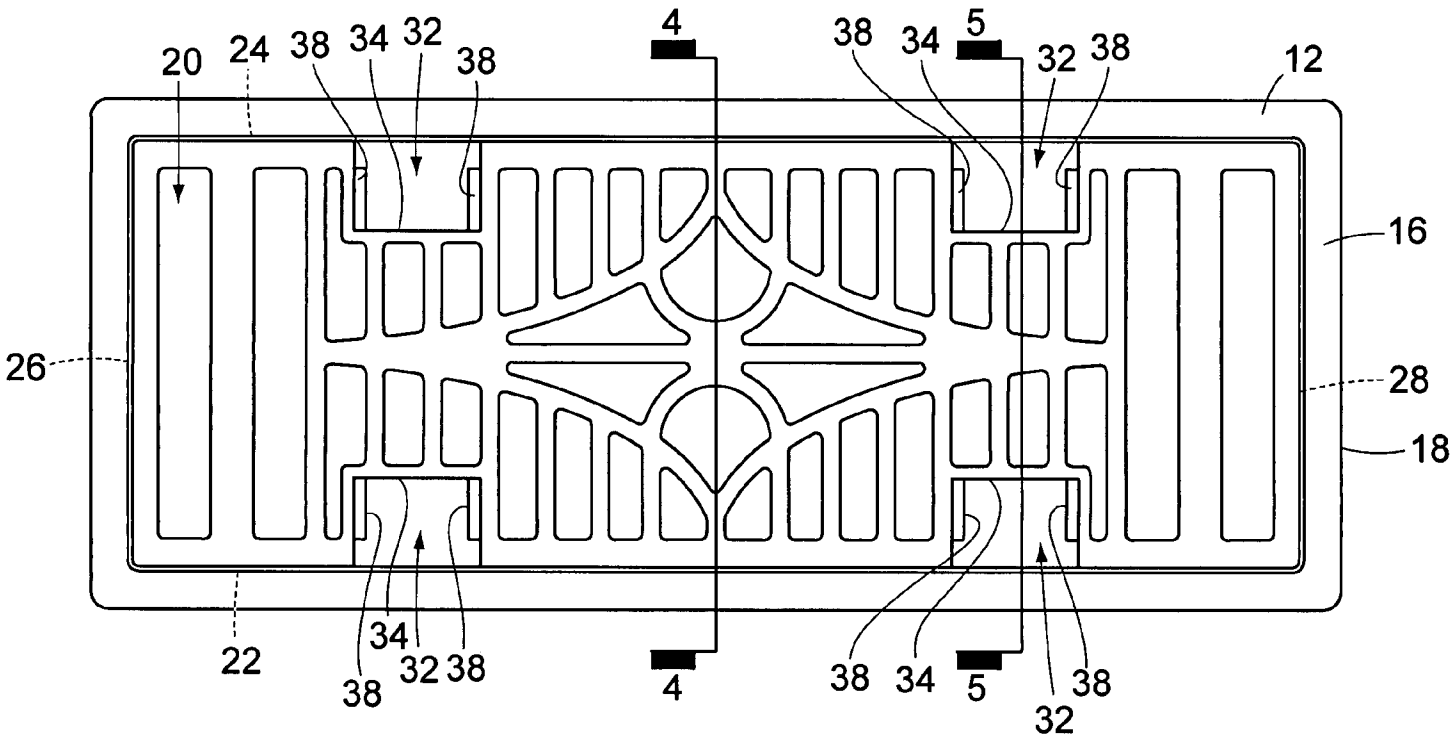
FIG. 1 is a top plan view of a framed faceplate of the register assembly of the invention.
Figure 2:
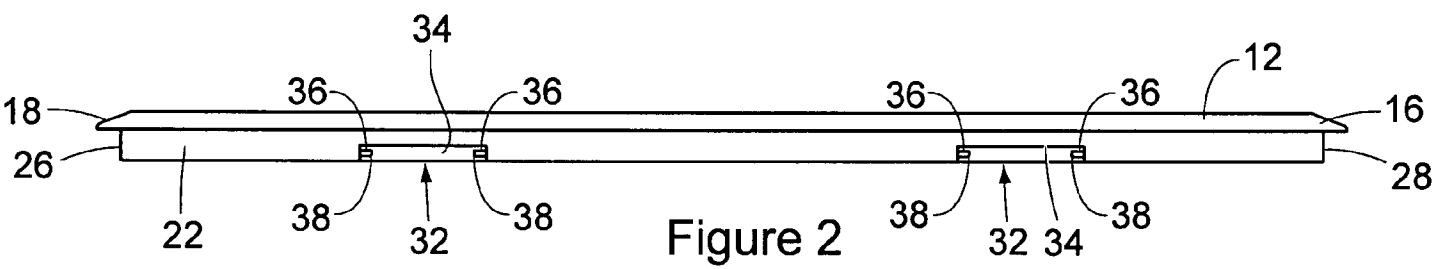
FIG. 2 is a side elevation view of the faceplate of FIG. 1.
Figure 3:
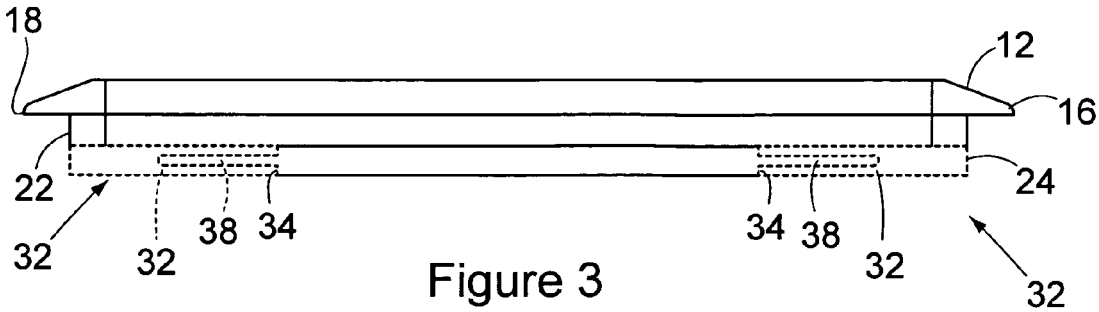
FIG. 3 is an end elevation view of the faceplate of FIG. 2.
Figure 4:
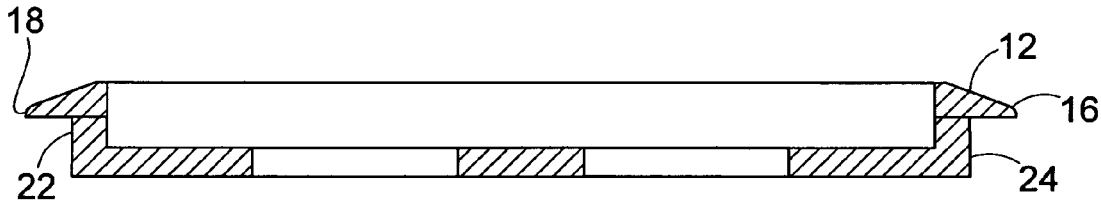
FIG. 4 is a cross section of the faceplate taken along the line 4—4 of FIG. 1.
Figure 5:
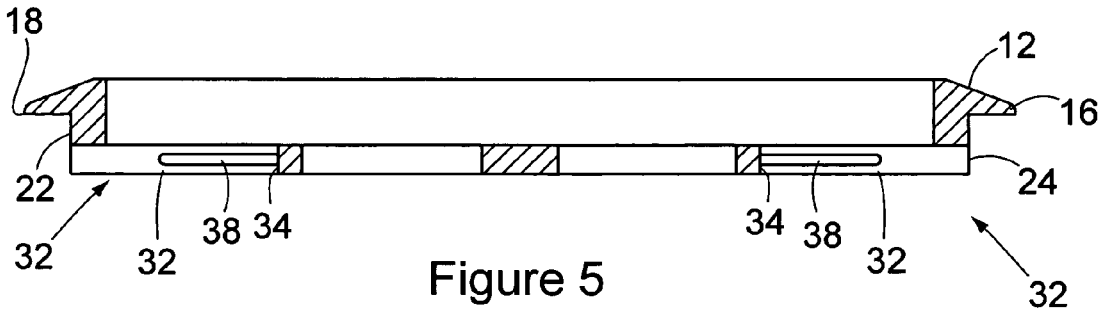
FIG. 5 is a cross section of the faceplate along the line 5—5 of FIG. 1.

The register assembly of the invention is designed to be used with a damper assembly of the type disclosed in the U.S. Patents of Berger U.S. Pat. No. 6,309,297 B1 and U.S. Pat. No. 6,506,113 B2, the disclosures of both being incorporated herein by reference. As stated earlier, damper assemblies of this type are provided in a variety of different sizes to fit different size air duct openings. A common feature of each of the different damper assemblies is that they include a plurality of pawl projections that each project inwardly from an interior surface of the damper base. Each of the projections is positioned to receive a tab of a faceplate that is being removably attached to the damper assembly. Because the constructions of these damper assemblies are known in the art as shown in the above-referenced patents, they are not described in further detail here or shown in the drawing figures.

The register assembly of the invention is basically comprised of a framed faceplate 12 and a plurality of connectors 14 that are removably attachable to the faceplate and to an associated damper assembly. Each of the faceplate 12 and connectors 14 may be constructed from a variety of different materials such as metals, wood, or plastic. It is only desirable that the particular materials used to construct the faceplate 12 and connectors 14 have a certain degree of resilience to enable component parts of the connectors 14 to resiliently flex relative to each other, as will be explained.

As seen in FIG. 1, the faceplate 12 has a rectangular configuration that is dimensioned to cover over the floor or wall opening associated with an air duct opening with which the register assembly of the invention is to be used. The faceplate 12 is designed with a framed border area 16 that extends around the top surface of the faceplate and defines the peripheral edge 18 of the faceplate. The outer dimensions of the faceplate peripheral edge 18 are also dimensioned sufficiently large so that the faceplate 12 will cover over each of the different sizes of damper assemblies available. A plurality of openings 20 are formed in the faceplate inside the border area 16. As shown in FIG. 1, the openings 20 are typically designed to have an aesthetically pleasing appearance. A variety of different patterns of openings 20 could be provided in a plurality of different faceplates.

As shown in FIGS. 2–5, the framed border 16 of the faceplate 12 is positioned on an upper portion of the faceplate. The faceplate also has a lower portion defined by sidewalls 22, 24, 26, 28 that are positioned inwardly from the faceplate peripheral edge 18 and below the framed border 16 of the faceplate. The positions and dimensions of the faceplate sidewalls 22, 24, 26, 28 are determined to enable the sidewalls to be inserted into an opening cut in a floor or wall for an air duct opening. With sidewalls 22, 24, 26, 28 inserted into the floor or wall opening, the framed border 16 of the faceplate conceals the opening.

A plurality of notches 34 are recessed into the elongated faceplate sidewalls 22, 24. Notches could also be provided in the shorter sidewalls 26, 28. Each of the notches 32 has a back wall 34 and a pair of opposed walls 36 that define the interior of the notch. Opposed, projecting tongues or ribs 38 project outwardly from the opposed walls 36 of each notch. The tongues 38 extend along the length of the opposed walls 36 to the notch back wall 34. In the particular embodiment of the faceplate 12 shown in the drawing figures, there are four notches 32.

FIGS. 6–9 show the construction of each of the connectors 14 used with the faceplate 12 of the invention. With the faceplate 12 having four notches 32, the register assembly of the invention will make use of four connectors 14. For different numbers of notches, different numbers of connectors are used. All of the connectors 14 used with each faceplate 12 are the same in construction.

Each connector 14 is basically constructed with a first portion 42 and a second portion 44 that are oriented at an angle relative to each other. In the preferred embodiment the two portions 42, 44 define a right angle.

Figure 6:
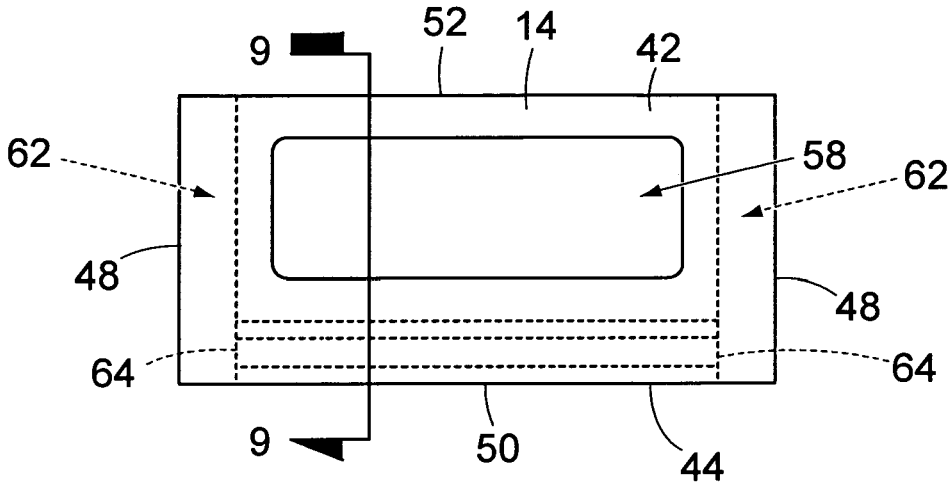
FIG. 6 is a top plan view of one of the plurality of connectors of the invention.

As shown in FIG. 6, the first portion 42 of the connector 12 has a rectangular configuration defined by a pair of opposite sidewalls 48 and a front wall 50 and opposite back wall 52. The first portion 42 also has a top surface 54 and an opposite bottom surface 56. An opening 58 extends through the connector first portion 42 from the top surface 54 to the bottom surface 56. The rectangular configuration of the connector first portion 42 is dimensioned to fit into each notch 32 of the faceplate 12 with the connector first portion sidewalls 48 opposing the notch opposed walls 36.

Figure 7:
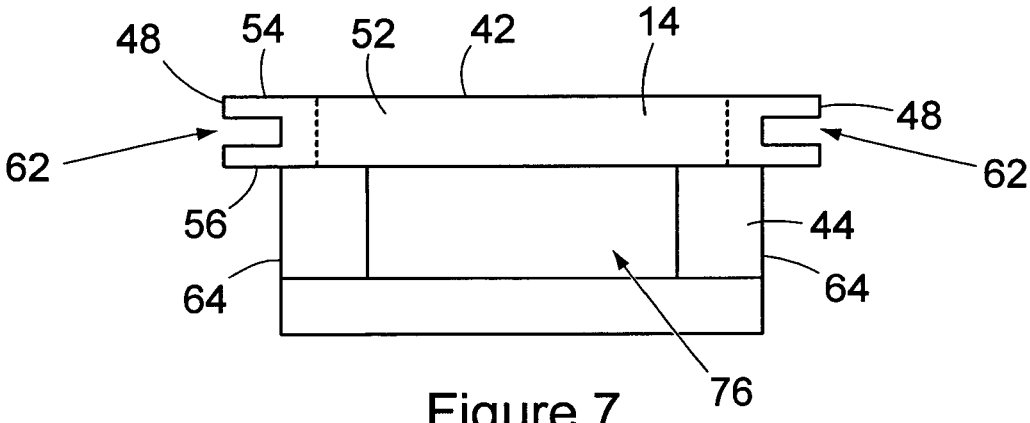
FIG. 7 is a side elevation view of the connector.

As seen in FIG. 7, each of the connector sidewalls 48 is provided with a groove 62 that extends through the sidewall. The grooves 62 are dimensioned to receive the notch tongues 38 that project from the opposed walls 36 of the faceplate notches 32. Engagement of the faceplate tongues 38 in the connector grooves 62 holds the connector in the faceplate notch 32.

The connector first portion 42 is dimensioned to be received in each faceplate notch 32 in two positions of the connector relative to the notch. In the first position of the connector 14 relative to the faceplate notch 32, the back wall 52 of the connector first portion is positioned against the notch back wall 34 with the notch tongues 38 positioned in the connector groove 62. In the second position of the connector 14 relative to the faceplate notches 32, the front wall 50 of the connector first portion is positioned against the notch back wall 34 with the notch tongues 38 positioned in the connector grooves 62. In each of the first and second positions of the connector 14 relative to the faceplate 12, the connectors 14 are removably attached to the faceplate 12 without the use of separate fasteners, for example screw-threaded screw and nut fasteners.

Figure 8:
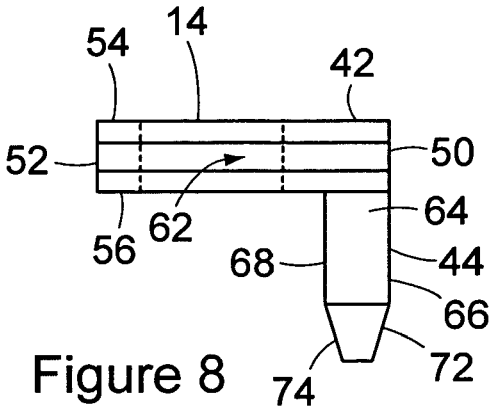
FIG. 8 is an end elevation view of the connector.
Figure 9:
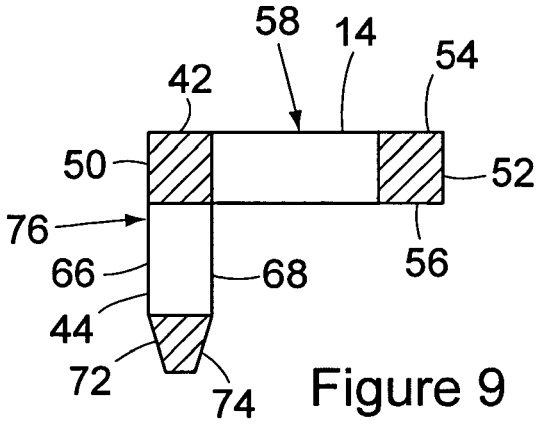
FIG. 9 is a cross-section of the connector along the line 9—9 of FIG. 6.
Figure 10:
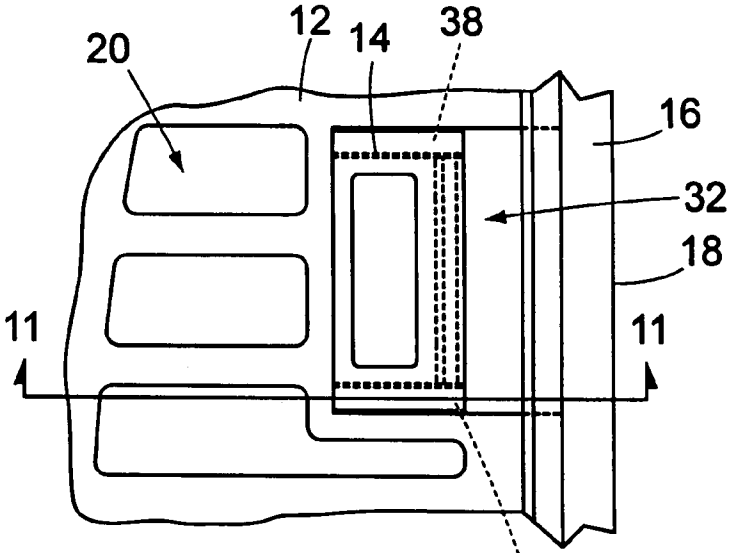
FIG. 10 is a partial view of the one of the connectors mounted in one of its adjusted positions relative to the faceplate.
Figure 11:
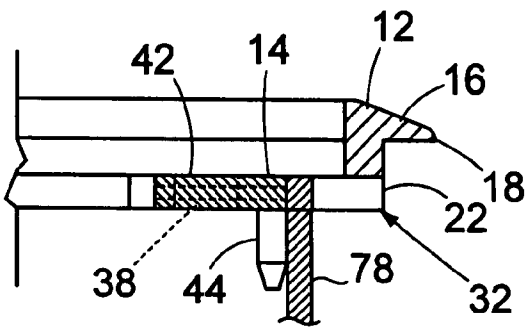
FIG. 11 is a partial side view of the connector and faceplate shown on FIG. 10.
Figure 12:
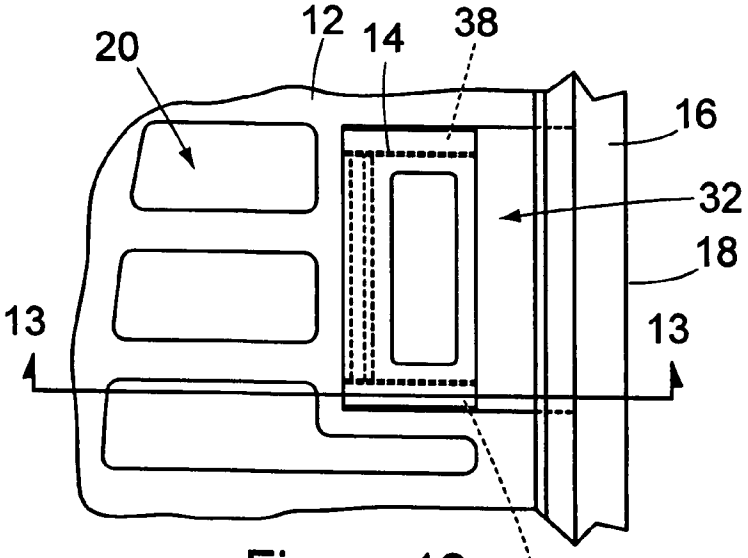
FIG. 12 is a partial view of the faceplate and one of the connectors in a second adjusted position of the connector.
Figure 13:
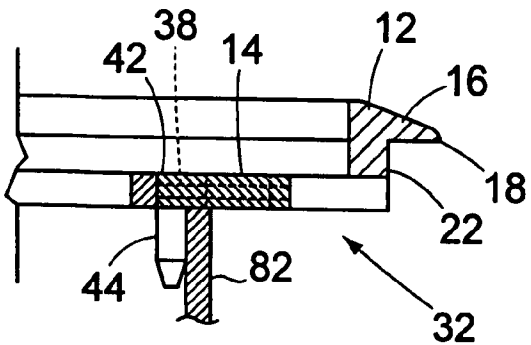
FIG. 13 is a partial side view of the faceplate and connector of FIG. 12.

Each second portion 44 of each connector 14 projects outwardly from the first portion bottom surface 56 adjacent the first portion front wall 50. As seen in FIGS. 6 and 7, each second portion 44 has a general rectangular configuration with a pair of opposite sidewalls 64 and a front wall 66 and opposite back wall 68. Both the front wall 66 and back wall 68 have respective tapered portions 72, 74 at the lower ends of the walls, as best seen in FIGS. 8 and 9. An opening 76 also passes through the connector second portion 44 from the front wall 66 to the back wall 68. The opening 76 gives the connector second portion 44 a certain resilience that enables the second portion 44 to be resiliently flexed relative to the first portion 42. The openings 76 are dimensioned to receive the projections or pawls of the damper assemblies described in the earlier referenced patents. As stated earlier, each connector 14 can be removably attached to the framed faceplate 12 in a first and second position of the connector relative to the faceplate. This adapts the faceplate 12 for removable attachment to damper assemblies of different sizes. FIG. 11 shows a partial, side sectioned view of a connector 14 inserted in a notch 32 of the faceplate 12 in the first position of the connector relative to the faceplate. It can be seen that in the first position of the connector 14, the connector second portion 44 is positioned outwardly to its greatest extent relative to the faceplate peripheral edge 18. With all of the four connectors 14 removably attached to the faceplate 12 in their first relative positions as shown in Figure 11, the faceplate 12 is adapted for removable attachment to the larger damper assembly 78 construction. FIG. 13 shows a partial, side sectioned view of a connector 14 removably attached in a notch 32 of the faceplate 12 in the second relative position of the connector 14 to the faceplate. In the second position of the connector 14 relative to the faceplate 12, the connector second portion is positioned radially inwardly from the faceplate peripheral edge 18 to its greatest extent, as shown in FIG. 13. This adapts the faceplate 12 for removable attachment to a damper assembly 82 of the smaller size. Each of the second portions 44 of the connectors attached to the faceplate 12 in the relative positions shown in FIG. 13 are positioned to be inserted inside the side walls of the damper assembly base in attaching the faceplate to the damper assembly 82. In removably attaching the framed faceplate 12 with the removably attached connectors 14 to a damper assembly, the faceplate is first positioned over the damper assembly of the appropriate size, i.e., a larger 78 or smaller 82 damper assembly, with the connector second portions 44 positioned just above the projections on the interior surfaces of the damper assembly side walls. The faceplate 12 and attached connectors 14 are then moved downwardly toward the damper assembly inserting the four connector second portions 44 inside the damper assembly side walls. The tapered portions 72 of the front walls 66 of the connector second portions slide over the projections or pawls of the damper assembly causing the connector second portions 44 to resiliently flex inwardly relative to the first portions 42 and the faceplate 12. When the tapered portions 72 pass over the damper assembly projections, the connector second portions 44 snap back into their original positions relative to the first portions 42 as shown in FIGS. 8 and 9, with the damper assembly projection being received in the connector second portion opening 76. In this way, the connector second portion opening 76 acts as a recess that receives the damper assembly projection to removably attach each connector 14 to the damper assembly projection, and removably attach the faceplate 12 to the damper assembly.

Although the present invention has been described above by reference to specific embodiments, it should be understood that modifications and variations of the invention may be constructed without departing from the scope of the invention defined in the following claims.

The invention claimed is:

1. A register assembly with an adjustable faceplate, the register assembly comprising:

a damper having a base and at least one louver on the base for controlling a flow of air across the base;

a faceplate having a configuration for covering over and concealing the damper;

at least one connector having a first portion that is removably attachable to the faceplate and a second portion that is removably attachable to the damper to removably attach the faceplate to the damper;

the connector being one of a plurality of connectors that are together removably attachable to the faceplate and are together removably attachable to the damper to removably attach the faceplate to the damper;

the faceplate having a peripheral edge and a plurality of notches spacially arranged around the peripheral edge;

the first portion of each of the connectors being removably insertable into a notch of the faceplate in removably attaching the connector first portion to the faceplate; and, one of the faceplate notch and connector first portion having a projecting tongue and the other of the notch and first portion having a groove that receives the tongue in removably attaching the connector first portion to the faceplate.

2. The register assembly of claim 1, further comprising:

the plurality of connectors having a same configuration.

3. The register assembly of claim 1, further comprising:

one of the damper base and the connector second portion having a projection and the other of the damper base and connector second portion having a recess that receives the projection in removably attaching the connector second portion to the base.

4. A register assembly with an adjustable faceplate, the register assembly comprising:

a damper having a base and at least one louver on the base for controlling a flow of air across the base;

a faceplate having a configuration for covering over and concealing the damper;

at least one connector having a first portion that is removably attachable to the faceplate and a second portion that is removably attachable to the damper to removably attach the faceplate to the damper;

the connector being one of the plurality of connectors that are together removably attachable to the faceplate and are together removably attachable to the damper to removably attach the faceplate to the damper;

the first portion of each connector is configured to be engaged with the faceplate and moved in a first direction of the connector relative to the faceplate in removably attaching the first portion to the faceplate; and, the second portion of each connector is configured to be engaged with the damper and is moved in a second direction of the connector, different from the first direction, relative to the damper in removably attaching the second portion to the damper.

5. The register assembly of claim 4, further comprising:

the first direction and the second direction being oriented at an angle.

6. The register assembly of claim 1, further comprising:

the connector being a single piece consisting essentially of the first portion and the second portion.

7. A register assembly with an adjustable faceplate, the register assembly comprising:

a plurality of different sized dampers, each damper of the plurality of dampers having a base and at least one louver on the base for controlling a flow of air across the base;

a faceplate having a configuration for covering over and concealing each damper of the plurality of dampers;

a connector that is removably attachable to the faceplate and is removably attachable to each damper of the plurality of dampers to alternatively removably attach the faceplate to each of the dampers; and the connector being removably attachable to the faceplate in a plurality of different positions of the connector relative to the faceplate and the connector in each position relative to the faceplate being removably attachable to a damper of the plurality of dampers.

8. The register assembly of claim 7, further comprising:

the connector being one of a plurality of connectors that are together removably attachable to the faceplate and are together removably attachable to each damper of the plurality of dampers to removably attach the faceplate to each damper.

9. The register assembly of claim 8, further comprising:

the plurality of connectors having a same configuration.

10. The register assembly of claim 9, further comprising:

each connector being configured to be engaged with the faceplate and moved in a first direction of the connector relative to the faceplate in removably attaching the connector to the faceplate, and each connector being configured to be engaged with each damper and moved in a second direction of the connector, different from the first direction of the connector, relative to the damper in removably attaching the connector to the damper.

11. The register assembly of claim 10, further comprising:

the first direction and the second direction being oriented at an angle.

12. A register assembly with an adjustable faceplate, the register assembly comprising:

a first damper and a second damper of different sizes, the first damper and second damper each having a base and at least one louver on the base for controlling a flow of air across the base;

a faceplate having a configuration for covering over and concealing both the first damper and the second damper; and, a connector that is removably attachable to the faceplate in first and second positions of the connector relative to the faceplate, the connector being removably attachable to the first damper in the first position of the connector on the faceplate and not being removably attachable to the second damper, and the connector being removably attachable to the second damper in the second position of the connector on the faceplate and not being removably attachable to the first damper.

13. The register assembly of claim 12, further comprising:

the connector being one of a plurality of connectors that are together removably attachable to the faceplate in the first and second positions and are removably attachable to the first damper in the first positions of the connectors on the faceplate and are removably attachable to the second damper in the second positions of the connectors on the faceplate.

14. The register assembly of claim 13, further comprising:

the plurality of connectors having a same configuration.

15. The register assembly of claim 14, further comprising:

each connector being configured to be engaged with the faceplate and moved in a first direction of the connector relative to the faceplate in removably attaching the connector to the faceplate in the first and second positions, and each connector being configured to be engaged with the first and second dampers and moved in a second direction of the connector, different from the first direction of the connector, relative to the first and second dampers in removably attaching the connector to the first and second dampers.

16. The register assembly of claim 15, further comprising:

the first direction and the second direction being oriented at an angle.

17. The register assembly of claim 12, further comprising:

the connector being a single piece that is removably attachable to the faceplate and each of the first and second dampers.

* * * * *